US007293772B2

(12) United States Patent
Dargue

(10) Patent No.: US 7,293,772 B2
(45) Date of Patent: Nov. 13, 2007

(54) POKER GAME WITH SPOKEN RANKS

(76) Inventor: Stan Dargue, 223 Lord Seaton Road, Toronto, Ontario (CA) M2P 1L2

( * ) Notice: Subject to any disclaimer, the term of this patent is extended or adjusted under 35 U.S.C. 154(b) by 0 days.

(21) Appl. No.: 11/224,674

(22) Filed: Sep. 12, 2005

(65) Prior Publication Data

US 2007/0057465 A1 Mar. 15, 2007

(51) Int. Cl.
*A63F 1/00* (2006.01)

(52) U.S. Cl. ..... 273/292; 273/274; 463/13

(58) Field of Classification Search ..... 273/292, 273/274, 309; 463/12, 13
See application file for complete search history.

(56) References Cited

U.S. PATENT DOCUMENTS 5,445,391 A * 8/1995 Gleason, Jr. ..... 273/304
6,062,563 A * 5/2000 de Keller ..... 273/274

OTHER PUBLICATIONS

Scarne's complete Guide To Gambling, John Scarne, pp. 586-592, Simon and Schuster, 1961.*
Scarne's Encyclopedia of Games, John Scarne, pp. 6-18, and pp. 29-30, Harper and Row Publishers, 1973.*
The Diagram Group, The Way To Play, "Liar Dice", 1975, Paddington Press Ltd., p. 168.*
Scarne's Encyclopedia of Game, "Draw Poker", "Stud Poker", John Scarne, Harper & Row Publishers, 1973, pp. 6-18 and 33-38.*
Shackleford, "Probabilities in Liar's Poker," www.wizardofododds.com/games/liars-poker.html, Jun. 30, 2003.

* cited by examiner

*Primary Examiner*—Benjamin Layno
(74) *Attorney, Agent, or Firm*—Muskin & Cusick LLC

(57) ABSTRACT

A card game that can be used for wagering purposes. A series of successive poker hands can be formed around a table, and upon formation of each hand a current player declares a rank of the hand which is better than a rank of a former hand. The other players at the table have the option to fold, challenge, or accept the hand in order to make an even better hand. If a current player is challenged and the declared hand by the current player was truthful, then the current player wins the pot.

16 Claims, 1 Drawing Sheet

POKER GAME WITH SPOKEN RANKS

BACKGROUND OF THE INVENTION

1. Field of the Invention

The present invention is directed to a method, apparatus, and computer readable storage medium directed to a poker game in which players speak a rank of their hand, wherein the other plays can accept or challenge.

2. Description of the Related Art

Casino poker games are currently a billion dollar industry. Texas Holdem is a very popular game which has also become a major media event. Casinos are always looking for new games to attract players to their casinos.

What is needed is a new type of poker game which is exciting for players to both play and watch.

SUMMARY OF THE INVENTION

It is an aspect of the present invention to provide an enjoyable card game that can be used for wagering.

The above aspects can be obtained by a method that includes (a) receiving a hand by a current player; (b) placing a wager into a pot by the current player; (c) declaring, by the current player, a declared hand; and (d) offering a next player an option to fold, challenge, or to assume the hand.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
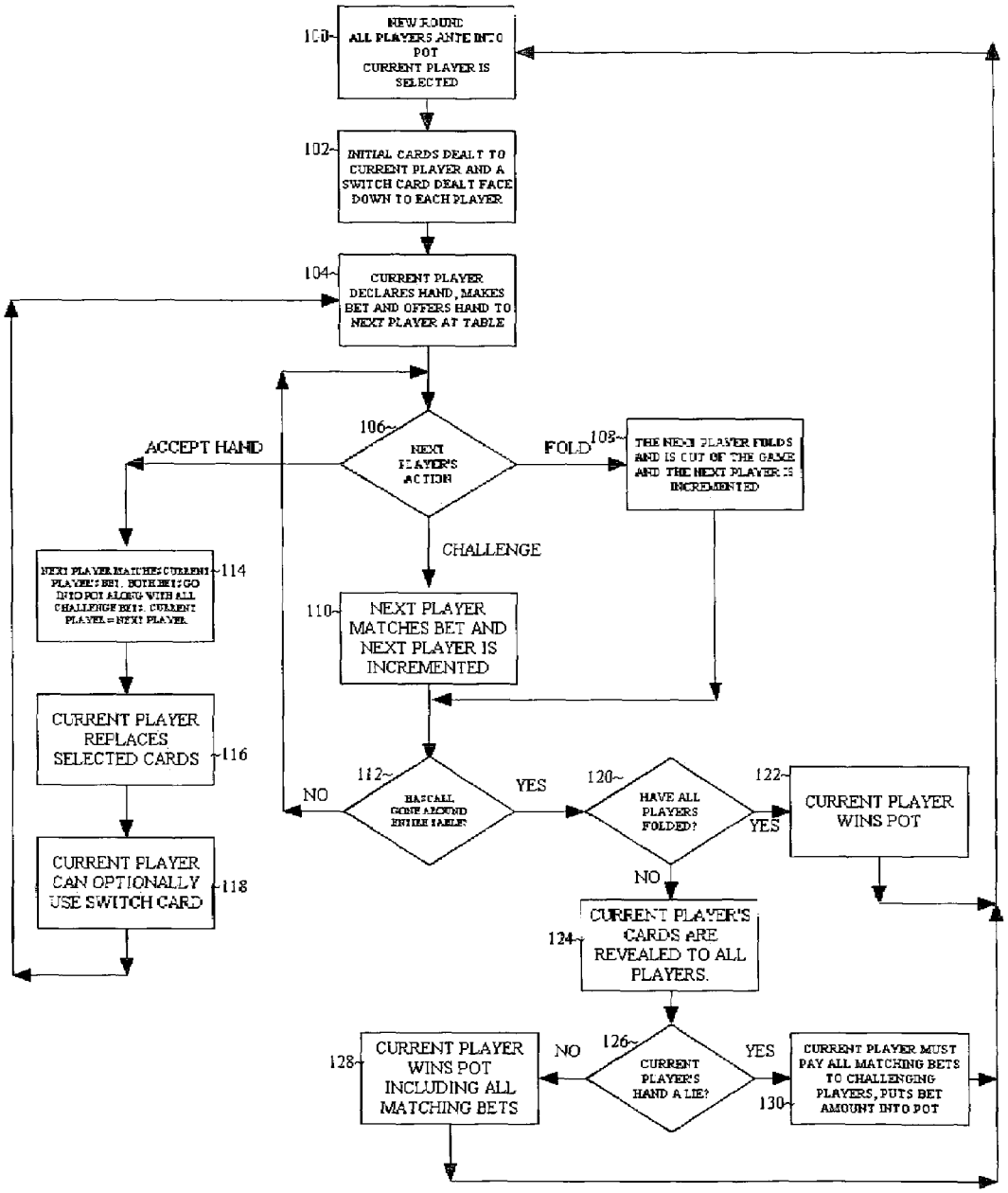
FIG. 1 illustrates an exemplary flowchart illustrating a method used to implement a wagering game, according to an embodiment.

Reference will now be made in detail to the presently preferred embodiments of the invention, examples of which are illustrated in the accompanying drawings, wherein like reference numerals refer to like elements throughout.

The present general inventive concept relates to a method, apparatus, and computer readable storage medium, for a new card game involving forming successive higher ranking poker hands, and bluffing if the player cannot form a better hand.

The method can start with operation 100, wherein all players place an ante into the pot. The current player referred to in other operations of the game (until the current player changes) is a first player which is selected to go first. The first player can be rotated upon each new game.

From operation 100, the method proceeds to operation 102, wherein initial cards are dealt to the current player (the initial hand can typically be five cards, although any other number of cards can be used as well), and a single "switch card" is dealt to each player face down (in an alternate embodiment more than one switch card can be dealt to each player).

From operation 102, the method proceeds to operation 104, wherein the current player declares a hand. This is accomplished by the current player speaking his hand out loud. The hand the player speaks can be his or her real hand or a "bluff." For example, if the player cards are 2h 2d 3c 9h Kh, the player might speak "a pair of two's" which would be truthful. If the player speaks, "three of a kind" this is permissible but would be considered a bluff (or lie) in the game. The current player may or may not be allowed to make use of his or her switch card before deciding upon a hand (depending on the rules of the current embodiment being played), see operation 118 for discussion on use of a switch card.

If the current player is not the first player to play in the round, then the current player must declare a hand that is better than the hand that was declared by the previous current player. There may optionally be two exceptions to this rule (depending on the embodiment currently being played). The current hand can be equal to the previously declared hand (call) if on both conditions: (or either, depending on the variation being played): the player has used a switch card (see operation 118), or where cards are exchanged (see operation 116).

After the player has spoken his or her hand in operation 104, the method proceeds to operation 106 wherein the play goes to the next player. If the players are seated in a circle, the next player can be the player clockwise (or counter-clockwise) from the previous player (the current player in operation 104). The next player should now make a choice, he or she can: accept the current player's hand, challenge, or fold. Each of these options will be described below in more detail, but generally, if the next player thinks the current player is lying regarding his or hand (the hand the current player spoke in operation 104), the next player may want to challenge. If the next player decides not to play any more (and hence not wager any more money), the next player can fold and exit the round. If the next player believes the current player's spoken hand (or is afraid to challenge), then the next player can accept the current player's spoken hand and continue playing.

From operation 106, if the next player decides to fold, then the method can proceed to operation 108, wherein the next player can exit from the round. The next player does not need to make any further wagers in this round and will typically lose any wagers he or she has placed in the current round. The next player can be incremented, which means what is referred to herein as the next player is now the player down the table from the player that has just folded. The method can then proceed to operation 112, which determines whether all players at the table have had a chance to take an action regarding the current player's spoken hand. If play has gone around the entire table (e.g. all other players at the table have had a chance to accept, challenge, or fold in response to the current player's hand), then the method can proceed to operation 120, wherein it is determined whether all players have folded. If all players have folded, then the method proceeds to operation 122, wherein the current player wins the pot and all wagers on the table. The game can then proceed to operation 100 which starts a new round with a new current player (typically the current player in operation 100 can be rotated around the table).

If in operation 120 it is determined that all players have not folded, then the method proceeds to operation 124, wherein the current player's cards are revealed. To make it to this operation means no player at the table has accepted the current player's hand to continue playing.

From operation 124 the method can proceed to operation 126 which determines whether the player's declared hand is a lie. This is of course done by comparing the best poker hand of the current player's cards with what the player had declared in operation 104. Note that if the current player's cards form a poker rank that is greater than the current player's declared hand (e.g. the player declares three of a kind when he or she really has four of a kind), then this can be considered a truthful declaration. If the determining determines that the player did not lie, then the method proceeds to operation 126 wherein the current player wins the pot and all matching bets. The method can then proceed to operation 100 which begins a new round.

If the determining in operation 124 determines that the player's declared hand (from operation 104) is a lie, then the method can proceed to operation 130, wherein the current player must match all matching bets to challenging players and puts his or her bet amount into the pot. Of course, here the current player is being penalized for bluffing and not being able to fool the other player(s). The method can then proceed to operation 100, which can begin a new round.

From operation 106, the next player can opt to accept the hand and the method proceeds to operation 114, wherein the next player should match the current player's bet and both bets can go into the pot along with any challenge bets that were made by other players. In other words, any players that challenged the current player by placing a challenge bet (or wager) lose their challenge wagers into the pot and lose their opportunity to challenge. The next player (depending on the rule variation) may also be allowed to raise, by wagering an amount more than the current player's bet which would need to be matched by further players if they want to continue playing. What is referred to now as the current player is now the next player (e.g. current player=next player).

From operation 114, the method can proceed to operation 116, wherein the current player replaces cards he or she wishes to replace to make a hand.

From operation 116, the method can proceed to operation 118, wherein the current player can optionally use the switch card by switching the switch card with any card in the current player's hand. In an alternative embodiment, the switch card must be used before operation 116 (before the player sees the replacement cards). The current player may (or may not, depending on the rule variation being played) be required to pay for the privilege to use his or her switch card (e.g. by paying to the pot an amount such as the ante amount). In a further embodiment, more than one switch card can be dealt and available to the player (e.g. 2, 3, or more), upon which either all of the switch cards can be used or only one out of the plurality of switch cards can be used (depending on the rule variation being played). If more than one switch card is allowed to be used at the same time and is going to be used by the current player, then the current player may pay only once (to use multiple switch cards) or the ante amount times the number of switch cards he or she is going to use (depending on the rule variation).

From operation 118, the method can proceed to operation 104, wherein the current player declares his or her hand, makes a bet, and offers the hand to the next player at the table. The method continues as described herein.

From operation 106, the next player can choose to challenge, wherein the method proceeds to operation 110. The next player would typically do this when the next player believes the current player is lying about his or her hand. In operation 110, the next player matches the bet (a challenge wager).

Note that if the next player decides to challenge and the further player decides to accept the current player's hand, then the challenge wager placed by the next player is forfeited to the pot and the next player may or may not be out of the hand (depending on the rule variation currently being played).

The next player is incremented (e.g. what is referred to as the "next player" is now the next player to the next player around the table).

From operation 110, the method can proceed to operation 112, which is described herein.

An example of an exemplary round will now be presented.

All of the players (in this example there are seven players) place an ante into the pot. The dealer then deals five cards to player one (lets say Ah Ad 3c 9d Js). Only player one sees the cards at this point. The dealer also deals a single switch card to each player (visible only to each respective player). In this example, the switch cards for players one through seven are (5d, 6s, Jd, Ac, As, Qs, 4h).

Then, player one bets $1 and says he has a pair of aces. This is not a lie since the five cards do comprise a pair of aces. The play goes to player two, who can fold, challenge, or accept.

Then, player two accepts and bets $1 and discards the (3c, 9d, Js), and is dealt (2s, 2h, 5d) which leaves (Ah Ad 2s 2h 5d). Player two then declares that he has two pair (which he does).

Then, player three accepts and bets $1. Player three discards the 5d and is dealt a 8h. Player three does not have an improved hand over the prior two pair, so he declares (a lie) that he has a full house (2 A's and 3 2's). The current player may be required (depending on the variation being played) be required to either: declare his or her exact hand (e.g. "three aces a king of spades and a queen of clubs,") or the player may be required to declare a general rank of the hand (e.g. "three of a kind,") or the player may be required to declare a specific hand without kickers (e.g. "three aces,") or the player may be required to declare an "almost exact" hand. An "almost exact" hands is for example, "three aces with a jack kicker," or "diamond flush of 9 to K" or "straight to the queen." The "almost exact" call declares relevant cards but cards or information that is not really relevant (or only relevant in a miniscule way) does not have to be called (e.g. if a player has three aces and a jack (the kicker) and a six, the six is mostly irrelevant and would not have to be called). The kicker can be important because a better hand can be made using the same three of a kind with a higher kicker. The "almost exact" calls allow for the most challenging game while not requiring calling of unimportant information.

Then, play goes to player four who accepts (of course player four should have challenged had he known player three was lying). Player four bets $1 and sees the cards and now realized player three was lying, but it is too late. Player 4 discards the 8h and is dealt a 7d to make (Ah, Ad, 2s, 2h, 7d). Player four then uses his switch card (Ac) with the 7d and declares that he has a full house. Here the hand rank is not better than the previous player but the full house is 3 A's and 2 2's which is a higher full house than the prior one. Also, note that when either the switch card is used or a replacement card is used, the hand can be equal in rank to the prior rank (in an embodiment). Thus, to declare this hand is acceptable.

Then, play goes to player five who bets $1 and accepts the prior player's statement. The cards are now (Ah Ad Ac 2s 2h). Player five discards the 2s and 2h hoping to make a higher full house. He is dealt a (3d 9c). He then uses his switch card (As) to make four of a kind and declares his hand to be "four of a kind."

Then, player six bets $1 and challenges player five. Play then goes to player seven, who also challenges player five and bets $1. Play then goes to back to player one who folds (drops out of round and does not bet further but loses all his wagers for the round). Play then goes to player two who challenges and bets $1. Play then goes to player three who challenges and bets $1. Play then goes to player four who folds.

Since all of the players have had a chance to play (and none of the players decided to accept the hand), player five now reveals his cards to reveal the four aces. Since player five was telling the truth, player five wins the pot and everyone's challenge bets. If player five was lying, then player five would pay players six, seven, two, and three $1 each and player five puts his $1 bet into the pot, and a new round can begin. In an alternate embodiment, all of the remaining players (player six, seven, two, and three) would split the pot in this instance.

In a further embodiment, the game can be played using one or more wild cards in the deck. Also, a special deck (e.g. an "English Short Deck" with only 7-Ace in the four suits), or two such decks or more mixed, can be used as an alternative to a standard 52 card deck. Wild card(s) can also be added. In a further embodiment, a deck with only 9-Ace in the four suits can be used, or 2, 3 or more such decks can be combined with or without wild cards.

It is also noted that any and/or all of the above embodiments, configurations, variations of the present invention described above can be mixed and matched and used in any combination with one another.

Moreover, any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method to play a poker type wagering game between a plurality of players, the method comprising:

placing a wager into a pot by all players;

providing deck(s) of playing cards and dealing only one hand being a current hand using the cards;

selecting a current player;

viewing the current hand by a current player but not by any other players;

declaring to other players a poker hand rank based on the current hand by the current player by truthtelling or lying about the hand rank; and allowing a next player to choose one of these three available options: 1) fold, 2) challenge, 3) to assume the current hand in which the next player views the current hand and tries to improve the current hand; wherein the dealing comprises dealing a switch card to each of the plurality of players, and when the next player tries to improve the current hand the next player replaces a card chosen by the next player in the current hand with the next player's switch card.

2. A method as recited in claim 1, further comprising replacing, by the next player, selected cards from the current hand in order to improve the current hand.

3. A method as recited in claim 1, wherein if the next player decides to fold, then offering a successive player to the next player the option to fold, challenge, or to assume the current hand.

4. A method as recited in claim 3, wherein if all of the players aside from the current player fold, then the current player wins the pot.

5. A method as recited in claim 1, wherein if the next player decides to challenge, then offering a successive player to the next player to choose one of these three available options 1) fold, 2) challenge, 3) assume the current hand.

6. A method as recited in claim 5, wherein if all players aside from the current player have challenged, if the declared hand was truthful, then the current player wins the pot.

7. A method as recited in claim 6, wherein the declared hand rank is considered truthful if the hand rank is better than the declared hand rank.

8. A method as recited in claim 7, wherein if all players aside from the current player have challenged, if the declared hand was a lie, then the current player must pay a penalty.

9. A method as recited in claim 8, wherein the declared hand rank is considered truthful if the hand rank is better than the declared hand rank.

10. A method as recited in claim 5, wherein if all players aside from the current player have challenged, if the declared hand was a lie, then the current player must pay a penalty.

11. A method as recited in claim 1, wherein if the next player decides to assume the current hand, then the method further comprises:

wagering by the next player;

replacing, by the next player, selected cards from the current hand;

declaring an improved hand value which has a higher rank than a rank of the declared hand.

12. A method as recited in claim 1, wherein if the next player challenges then a declared hand rank by the current player is considered truthful if a hand rank of the current hand is better than the declared hand rank.

13. A method to play a poker type wagering game between a first player, a second player, and a third player, the method comprising:

anteing an ante amount into a pot, by the first player, the second player, and the third player;

dealing an initial hand to the first player allowing only the first player to view the initial hand;

declaring an initial hand poker rank by the first player to all other players;

offering the second player an option to fold, accept, or challenge;

accepting by the second player and wagering an accept wager by the second player, allowing only the second player to view the initial hand;

replacing, by the second player, selected cards in the initial hand to form a second hand;

declaring a second hand poker rank by the second player to all other players;

offering the third player the option to fold, accept, or challenge;

challenging by the third player and wagering a challenge amount by the third player;

offering the first player the option to fold, accept, or challenge;

challenging by the first player and wagering a second challenge amount by the first player;

revealing the second hand to all players;

if the declared second hand poker rank is equal to an accurate poker rank of the second hand, then the second player wins the pot and the challenge amount and the second challenge amount.

14. A method as recited in claim 1, wherein if the declared second hand value is not equal to a rank of the second hand, then the second player pays a penalty.

15. A method to play a poker type wagering game between a plurality of players, the method comprising:

placing a wager into a pot by the current player;

dealing a hand to a current player from a deck of cards and allowing only the current player to view the hand;

declaring, by the current player, a declared hand to all other players by either telling a truth or lying about a hand rank by verbally declaring the hand rank of the hand; and offering a next player to choose one of the three options: 1) fold, 2) if the next player challenged, then joining the next player's challenge, 3) assume the hand, wherein if the next player decides to challenge, then offering a successive player to the next player the option to fold, challenge, or to assume the hand, wherein if all players aside from the current player have challenged, if the declared hand was truthful, then the current player wins the pot.

16. A method as recited in claim 15, wherein the declared hand rank is considered truthful if the hand rank is better than the declared hand rank.

* * * * *